US009695640B2

(12) United States Patent
Eggers et al.

(10) Patent No.: US 9,695,640 B2
(45) Date of Patent: Jul. 4, 2017

(54) DRILL HEAD FOR A DRILL AND DRILL

(71) Applicant: IRWIN INDUSTRIAL TOOL COMPANY, Huntersville, NC (US)

(72) Inventors: Rainer Eggers, Steinkirchen (DE); Florian Probst, Freising (DE); Walter Hulm, Reichenkirchen (DE); Manfred Geier, Puchheim (DE)

(73) Assignee: IRWIN INDUSTRIAL TOOL COMPANY, Huntersville, NC (US)

( * ) Notice: Subject to any disclaimer, the term of this patent is extended or adjusted under 35 U.S.C. 154(b) by 1008 days.

(21) Appl. No.: 13/956,721

(22) Filed: Aug. 1, 2013

(65) Prior Publication Data

US 2014/0034395 A1 Feb. 6, 2014

(30) Foreign Application Priority Data

| | | |
|---|---|---|
| Aug. 3, 2012 | (DE) | 10 2012 015 369 |
| Aug. 3, 2012 | (DE) | 10 2012 015 370 |
| Aug. 3, 2012 | (DE) | 10 2012 015 371 |
| Aug. 3, 2012 | (DE) | 10 2012 015 372 |

(51) Int. Cl.

| | |
|---|---|
| ***E21B 10/55*** | (2006.01) |
| ***E21B 10/36*** | (2006.01) |
| ***E21B 10/44*** | (2006.01) |
| ***E21B 10/58*** | (2006.01) |

(52) U.S. Cl.

CPC ..... *E21B 10/36* (2013.01); *E21B 10/445* (2013.01); *E21B 10/55* (2013.01); *E21B 10/58* (2013.01)

(58) Field of Classification Search

CPC ..... E21B 10/55; E21B 10/58; E21B 10/445; E21B 10/36

See application file for complete search history.

(56) References Cited

U.S. PATENT DOCUMENTS

| | | | |
|---|---|---|---|
| 4,951,761 | A | 8/1990 | Peetz et al. |
| 6,698,981 | B1 | 3/2004 | Beno et al. |

FOREIGN PATENT DOCUMENTS

| | | | |
|---|---|---|---|
| DE | 102008022899 | A1 | 11/2009 |
| EP | 0654580 | B1 | 8/1997 |
| EP | 1275457 | A1 | 1/2003 |
| EP | 1270162 | B1 | 2/2006 |
| GB | 530113 | A | 12/1940 |
| GB | 2377722 | A | 1/2003 |
| WO | 0107189 | A1 | 2/2001 |
| WO | 2010036498 | A1 | 4/2010 |

*Primary Examiner* — David Andrews
*Assistant Examiner* — Kristyn Hall
(74) *Attorney, Agent, or Firm* — Eversheds Sutherland (US) LLP

(57) ABSTRACT

A drill head is provided with three main cutting edges each having a straight direction of extension with a predominant radial direction component. The directions of extension limit two adjacent main bore dust discharge sectors, each spanning a main sector angle. Three drill head cutting legs each forming a main cutting edge where the three main cutting edges have different lengths along their directions of extension. Concentric ring shaped removal areas overlap at least partially such that a triple removal area coverage is provided in an outer ring zone and a double removal area coverage is provided in an inner ring zone.

46 Claims, 4 Drawing Sheets

DRILL HEAD FOR A DRILL AND DRILL

The instant invention relates to a drill head made of hard metal, such as carbide, for a drill, such as a rock drill. Typically, a drill head, which is to be coupled to the drill shaft, consists of a hard metal. The entire drill head from the sides, which contact the borehole, from the tip to the helical turns of the drill shaft, is made of hard metal. Usually, rock drills comprising such high performance drill heads have a nominal drill diameter of less than 100 mm and are used to process brickwork, concrete or reinforced concrete by means of a portable electric percussion drilling machine or a hammer drill.

A hard metal drill head comprising three cutting legs for a rock drill is known from EP 1 270 162 B1. The cutting legs are arranged in pairs at an angle of 120° relative to one another and in each case form a main cutting edge, which extends substantially straight from the radial outer end of the cutting leg to a work rotation axis of the drill head. Auxiliary cutting edges comprising a shorter radial length are in each case embodied between two main cutting edges at equal distances to one another and to the main cutting edges. All of the main and auxiliary cutting edges run together in a chisel-free drill head tip. The chisel-free drill tip is to prevent the drill from moving around in the hole, so as to improve the roundness of the hole. The drill head, however, has the disadvantage that the six cutting edges in the borehole create a high friction on the drill cuttings, which were knocked out, which results in an enormous heat development. There is only little space between the cutting edges, which are narrowly arranged downstream from one another, to provide for a discharge of bore dust, which is why solidifications of the bore dust, which remained in the borehole, can result. In particular the cutting sharpness and durability of the drill suffers under the large friction and heating of the tool. Each of the main and auxiliary cutting edges defines a removal area, through which the respective cutting edge passes once during a rotation of the drill head, so as to remove material from the material, which is to be drilled and to transport it further into helical turns of the drill. The removal areas of the three main cutting edges cover one another completely; the removal areas of the auxiliary cutting edges cover approximately half of the removal areas of the main cutting edges. Based on a radial distance from the drill head tip to the outer end of the main cutting edges, a cutting edge thus passes through a radially outer portion of the radial distance three times and passes through a radially inner portion six times.

EP 1 275 457 A1 discloses a rock drill comprising a drill head made of hard metal, which encompasses a basic polygonal shape and three main cutting edges, which are in each case arranged relative to one another in pairs at a 120° angle.

A different hard metal drill head of a rock drill is known from EP 0 654 580 B1, in the case of which a main cutting edge extends diametrally across the drill head, and two short auxiliary cutting edges, which stand downstream from a drilling cone, which the main cutting edge spans around the drill head tip, are embodied on the drill head in feed direction of the drill. The positioning of the drill head in the borehole is thus substantially determined only by the course of the main cutting edge, which leads to a comparatively high drill head position inaccuracy and to lower borehole roundness.

In the case of known drills comprising three main cutting edges, a high hole quality is reached in response to the drilling by means of the support on three main cutting edges in the borehole. In the case of coarse-grained bore dust, it turned out, however, that, due to the small spaces between the cutting edges, it takes relatively long until the bore dust pours away, because it must first be broken up. In response to percussion drilling, however, a particularly quick discharge of bore dust is desirable, because compaction of bore dust, which has not been discharged from the borehole, leads to increased friction, heat and thus to higher wear of the drill head and because the drill feed rate decreases due to the damping of the impact energy by the drillings.

In the case of the known drill heads comprising three or more cutting edges, which are arranged at the same distances relative to one another, there is a greater chance that the cutting edges penetrate several times into the same recesses, which were already created in an earlier impact stroke. Bore dust located in the recesses absorbs impact energy and is thereby compressed, which impedes the bore dust from pouring away and which impedes the drill feed. The drill power is furthermore reduced relative to the drive power, because a high resistance must be overcome when the cutting edges are taken out of the recesses.

It is the object of the invention to provide a hard metal drill head, which overcomes the disadvantages of the state of the art, and which in particular attains a sufficient drill power with low drill head wear in particular without losses in the hole quality, wherein the stability is increased considerably.

This object is solved by means of different independent aspects of the invention which can be combined with one another, as they are specified in claims 1, 11, 21 and 30.

According to a first aspect of the invention, a drill head of hard metal for a drill, such as a rock drill, encompasses a mounting side to be turned towards a drill shaft of the drill for mounting, preferably welding, the drill head on the drill shaft and a free cutting side with three main cutting edges. The main cutting edges are in each case embodied along a particularly straight direction of extension with a predominant direction component in particular pointing purely radially towards an axial work rotation axis of the drill. The directions of extension limit two adjacent main bore dust discharge sectors, each spanning a main sector angle. According to the invention, the main sector angles are greater than 120°.

Surprisingly, it turned out that, by means of the measure according to the invention of embodying two main bore dust discharge sectors to be greater than 120°, the bore dust discharge is improved considerably in the case of hammer drilling with high impact energy as compared to a drill head comprising three bore dust discharge sectors, which have the same size, even in the case of a comparable total discharge volume, because coarse-grained drill cuttings can pour away directly, without having to be broken up initially.

Even though the spanning of two main bore dust discharge sectors beyond 120° is associated with a decrease of the further auxiliary bore dust discharge sector, it turned out that the bore dust discharge is improved considerably due to the two large main bore dust discharge sectors. Due to the lack of the rotational symmetry and point symmetry of the drill head associated with the increase of two bore dust discharge sectors, the drilling efficiency is increased. In response to the rotation of the drill head according to the invention, phases of higher abrasion and of lower abrasion alternate, whereby an improved adaptation of the drilling tool to an inhomogeneous drill material, such as concrete, is reached. The start of drilling or the resuming of drilling in boreholes, which already exist, is also facilitated by means of the drill head according to the invention, because the drill head does not fall into the last-formed borehole indentation due to its lacking rotational symmetry.

According to the invention, a main cutting edge is defined in particular when it is located in the course thereof, substantially on a conical jacket plane, the axis of symmetry of which coincides with the drill axis. It is clear that a main cutting edge can lead into a chisel structure at the drill tip, which can protrude from the conical jacket plane. Auxiliary cutting edges can be formed on the drill head according to the invention, but are recessed in axial direction to the conical jacket plane, along which the main cutting edges run. As described above, the bore dust discharge sectors are limited by substantially straight directions of extensions of the cutting edges, whereby it is clear that one cutting edge must run along the "imaginary" boundary line of the direction of extension, but can also be interrupted or can be missing completely in sections. After the abrasion and after the bore dust of the drill cuttings has been created, the bore dust falls away at the cutting edge and reaches into a helical turn of the drill shaft via a bore dust channel in the bore dust discharge sector.

In a preferred embodiment, the main sector angles have the same size, which contributes to the reduction of an imbalance on the drill head. Preferably, the main bore dust discharge sectors are free from further cutting edges. Drill cuttings can thus be discharged unhindered, so that the detached material does not compress in subsequent percussion drill strokes. Preferably, the main drill bore dust sectors extend in axial direction of extension of the drill from a lateral or jacket surface of an imaginary drilling cone, which is spanned by the main cutting edges and the cone tip of which is located on the work rotation axis, up to helical turns of the drill.

In the area of the main bore dust discharge sectors, the free cutting side of the drill head can encompass edges for limiting cutting faces and/or open areas and/or bore dust guide edges, which, however, are located below the jacket surface of the drilling cone and which do not have any effect as cutting edges.

In a preferred embodiment, the two main sector angles are between about 125° and about 150°, preferably between about 130° and about 135°. Surprisingly, the inventors found an optimum with reference to the smoothness and drill cutting discharge in the case of these preferred angles for the materials, which are processed most frequently.

In a preferred embodiment, the main bore dust discharge sectors enclose an auxiliary bore dust discharge sector. In particular, the auxiliary bore dust discharge sector spans an auxiliary sector angle being smaller than or equal to 110° and greater than about 20°. In particular, the auxiliary sector angle is greater than about 50°. Preferably, the auxiliary sector angle is between about 100° and about 90°. The main sector angle and the auxiliary sector angle make up an angle sum of 360°.

In a preferred embodiment, one of the main cutting edges encompasses a larger length along the direction of extension thereof than the further main cutting edges. Preferably, all of the main cutting edges encompass a different length. The drill head can encompass a long main cutting edge, which is the longest main cutting edge of the three main cutting edges. The drill head can furthermore encompass a middle main cutting edge and a short main cutting edge, which is the shortest of the main cutting edges. The middle main cutting edge is longer than the short cutting edge and is shorter than the long main cutting edge. In a preferred embodiment, a longest of the main cutting edges or long main cutting edge encompasses a dome-shaped chisel tip, which is in particular formed point symmetric relative to the work rotation axis, as well as a long portion and a short portion, which are preferably formed diametrically opposite to each other relative to the work rotation axis and which each flow uninterruptedly, in particular steadily, into the chisel tip, so that an uninterrupted roof-shaped cutting course is embodied within and above the jacket surface of the drilling cone. The improved impact energy transfer and the effective tilting stability of the drill head in the borehole are advantageous hereby, in particular in view of the axial impact movement through the diametrally opposite cutting portions.

Preferably, a respective main cutting edge is in each case defined by an uninterrupted, in particular mainly straight crest course between a cutting face and an open area, which is located in the jacket surface or above the jacket surface of the drilling cone.

In a preferred embodiment, the auxiliary bore dust discharge sector is occupied by a chisel tip and/or the short portion of the main cutting edge, if applicable. In particular, a preferably straight direction of extension of the short portion divides the auxiliary sector angle into two substantially equally large sub-sectors. The short portion is not only used to crush coarse drill cuttings, but cuttings, which cannot be transported away via the auxiliary bore dust discharge sector, is guided into one of the main bore dust discharge sectors or vice versa.

In a preferred embodiment, a main cutting edge and/or two main cutting edges are dimensioned so as not to intersect, so that a cutting edge-free distance between the main cutting edges is formed for the bore dust discharge. Preferably, the main cutting edge and/or the two main cutting edges extend from a radially outer end towards a radially inner end on the drill head, preferably with a constant slope in axial direction. In particular, the radially outer ends are defined by a rounding of the main cutting edge to a radially outermost short side of a leg of the drill head. Preferably, the radially outer and inner ends of the main cutting edges are defined by a reduction of the continuous slope. In particular, the cutting edge-free, purely radial distance from the radially inner end of the main cutting edge of a longest main cutting edge is at least the length of the main cutting edge. In particular, the purely radial distance from the radially inner end of the further main cutting edge to the longest main cutting edge is at least 0.8-times the length of the further main cutting edge.

Not only the frictional cutting edge contact surface length in the borehole was reduced by shortening the main cutting edges on the drilling cone, which leads to a lower heat development and wear, but it was furthermore surprising that, in case of an overload, bore dust can discharge into an adjacent bore dust discharge sector via the cutting edge-free areas.

In a preferred embodiment, exactly three main cutting edges are formed on the drill head. Preferably, the drill head is connected to the drill shaft so as to be free from a tenon. By means of this measure it was possible to provide large bore dust discharge areas on all sides of the drill head.

Preferably, the mounting side of the drill head is free from any protrusion, in particular planar, which facilitates the mounting of the drill head to a drill shaft from a manufacturing aspect and which allows for a cost-efficient production. In particular, the drill head is free from any cutting plate or cutting insert and the cutting edges are embodied in once piece with the entire drill head.

In a preferred embodiment, the drill head has a substantially Y-shaped body with a basis leg and two side legs. In particular, wall surfaces, which are concave in radial direction, of the basis leg and of the side legs limit the bore dust discharge sectors, which run in particular substantially parallel to the axial drilling feed axis. The wall surfaces can transition so as to lead into the respective helical turn of the drill shaft. In particular the bore dust discharge sectors form a substantially constant concave curvature to the axial direction. The bore dust pours away evenly due to the constant curvature of the bore dust discharge grooves. In addition, the smooth curvature progression effects a homogeneous stress distribution at the drill head legs, so that larger impact forces can be absorbed.

In a preferred embodiment of the invention, the main dust discharge sectors as well as the auxiliary bore dust discharge sector are formed by means of an outer wall surface of the drill head, viewed in radial direction, which is to extend from the free cutting side of the drill head in axial direction, if possible continuously, to the respective helical turn of the drill shaft. The concave curvature around the axial direction can be substantially constant.

In a preferred embodiment, the directions of extension of two main cutting edges intersect at an intersection point, which is offset to the work rotation axis. A larger design scope for a particularly stable, positionally accurate or deeply penetrating chisel tip exists due to the radial offset of the directions of extension of the main cutting edge. The bore dust discharge away from the rotation axis of the drill can furthermore be influenced advantageously in accordance with the characteristic of the radial direction component, which points away from the work rotation axis.

In particular, the radial distance between one of the intersection points and the work rotation axis is not equal to the radial distance of another of the intersection points. In particular, all intersection points are offset to the work rotation axis. Preferably, all radial distances of the intersection point to the work rotation axis are different. This embodiment has the particular advantage that the chance that an impact recess is impacted again in the borehole in response to a rotation is decreased considerably as compared to known drills.

Preferably, the drill head is not rotationally symmetrical, that is, the drill head top view is always different in response to an arbitrary rotation of the drill head by less than 360°. Due to this asymmetry, the chance is reduced that the drill penetrates into the same impact recess several times in consecutive impact strokes and solidifies the bore dust, which has already been knocked out at that location or experiences an additional rotational resistance due to the impact recess edges.

In a preferred embodiment, a groove, which extends linearly parallel to the work rotation axis is preferably embodied in the outer layer side of a respective Y-leg, which runs in the drill work rotation direction preferably on the radially outer leg end. Preferably, a base of the groove runs mainly parallel to the main cutting edge of the respective leg. Preferably, a depth of the groove perpendicular to the direction of extension of the respective main cutting edge is more than about a tenth, preferably more than about a seventh of a radial leg width, measured on the radially outer end of the leg.

According to a second invention aspect, which can also be a further development of the afore-described invention aspect, a drill head of hard metal for a drill, such as a rock drill, comprises a mounting side to be turned towards a drill shaft of the drill for mounting, preferably welding, the drill head on the drill shaft and three drill head cutting legs, on the free cuttings sides of which, which are in particular substantially oriented in axial feed direction, a main cutting edge or main cutting edges are embodied, which encompasses in particular a substantially straight direction of extension comprising a mainly radial direction component, which faces radially to a work rotation axis, in particular vertically. According to the invention, the three main cutting edges encompass different lengths along the directions of extension thereof.

It turns out that the quantity of the bore dust, which accumulates locally at the cutting edges, can be influenced such that the bore dust flow is improved considerably in consideration of the bore dust discharge space, which is available as a whole as well as locally at the respective cutting edges, at least for the most frequent bore dust granulations. Due to the fact that in the case of the drill head according to the invention, the quantity of the generated bore dust is matched accurately to the bore dust quantity, which can be transported away locally and as a whole, less friction-promoting bore dust remains in the borehole, whereby it had been possible to reduce the operating temperature at the drill head and the wear thereof. The drilling capacity increased relative to the expended mechanical performance with the measure of designing the overall cutting edge length to the maximum bore dust quantity, which can be discharged, because the cutting friction is limited to the required measure. Surprisingly, this also resulted in an improvement of the feed rate, because impact energy from the hammer drill is now transferred directly to the rock, which is to be drilled, without damping the drill cuttings present in the borehole.

In a preferred embodiment, the main cutting edges extend on the respective drill head cutting leg with a constant direction component in axial drill feed direction and span a jacket/lateral surface of a drilling cone, the cone tip of which coincides with the work rotation axis of the drill, wherein in particular the length of the respective main cutting edge is defined by the portion of the main cutting edge that lies within the jacket surface.

The drill head can encompass a long main cutting edge, which is the longest main cutting edge of the three main cutting edges and can encompass a middle main cutting edge and a short main cutting edge, which is the shortest of the main cutting edges, wherein in particular the middle main cutting edge is longer than the short cutting edge and shorter than the long main cutting edge.

In a preferred embodiment, the directions of extension limit two adjacent main bore dust discharge sectors, which are in particular free from further cutting edges. The main bore dust discharge sectors extend in axial drill extension direction from a jacket surface, which is spanned by the main cutting edges and the tip of which is located on the work rotation axis, up to helical turns of the drill shaft. In particular, the direction of extension of the longest of the main cutting edges forms a common boundary between the two adjacent main bore dust discharge sectors. Preferably, the main bore dust discharge sectors in each case span a main sector angle greater than 120°. Due to the larger angle distance between the cutting edges, the large main sector angles facilitate the removal of the cuttings. A rotational asymmetry of the drill head furthermore results from the main sector angle increase, which leads to a particularly effective impact effect in the borehole, because the chance of once again processing the same areas decreases during a rotation.

In a preferred embodiment, the directions of extension of the second longest and of the shortest, main cutting edges limit an auxiliary bore dust discharge sector. Preferably, the auxiliary sector angle of the auxiliary bore dust discharge sector is less than or equal to 110°. In particular, the auxiliary bore dust discharge sector extends in axial drill extension direction from a jacket surface of an imaginary drilling cone, which is spanned by the main cutting edges and the tip of which is located on the work rotation axis, up to helical turns of the drill shaft. In particular, the auxiliary bore dust discharge sector is occupied by a short portion of the longest of the main cutting edges. The auxiliary bore dust discharge sector discharges bore dust, which is generated at the second longest and at the shortest main cutting edge as well as bore dust, which is not transported away completely via the main bore dust discharge sectors and which flows along the longest of the main cutting edges into the auxiliary bore dust discharge channel. The short portion of the longest main cutting edge breaks large drill cuttings, so that coarse drill cuttings flow away in spite of the smaller angle dimensions of the auxiliary bore dust discharge sector.

The beginning of a respective main or auxiliary bore dust discharge sector is defined by a positive or negative slope change of a respective crest of the main cutting edges to cutting faces and open areas. The slope does not change along a respective straight extension of the main cutting edges in the jacket surface of the drilling cone.

In a preferred embodiment, the longest of the main cutting edges, in particular the long main cutting edge, comprises a long portion and a short portion formed diametrically opposite relative to the work rotation axis R. In particular, the long portion flows preferably continuously into a chisel in the area of a drill tip, which coincides with the work rotation axis, said chisel extending preferably point symmetrically to the work rotation axis for centering of the drill head. Preferably, the chisel pierces the drilling cone in axial drill feed direction. In particular, the short portion continuously continues the longest main cutting edge for extending its length beyond the chisel by the length of the short portion. Preferably, the short portion flows into the chisel radially inwardly, preferably continuously. In particular, the long portion and the short portion of the longest main cutting edge run in particular straight relative to one another in radial direction offset in parallel and offset relative to the work rotation axis. The chisel in particular bridges the parallel offset.

In a preferred embodiment, the main cutting edges extend from a radially outer end to a radially inner end with an in particular constant slope relative to the axial direction, wherein the radially inner and outer ends are in each case defined by a change of slope, in particular a slope decrease, wherein a radial distance, particularly a recess within the drill head for discharging bore dust, which is free from any cutting edges, is formed between the respective radially inner ends of the shortest and/or the second longest of the main cutting edges. In particular, the distance is realized as a valley or groove substantially along the direction of extension of the longest of the main cutting edge. A quantity compensation between the bore dust discharge grooves is made possible by means of the recesses, which run along the longest main cutting edge and which connect the main and auxiliary bore dust discharge sectors, so that the overall bore dust discharge capacity is used in a particularly efficient manner.

In a preferred embodiment, the long main cutting edge runs ahead of the middle main cutting edge in work rotation direction of the drill, in particular as the immediately next main cutting edge. Preferably, the long main cutting edge runs ahead of the short main cutting edge in work rotation direction, in particular as the immediately next main cutting edge. Preferably, the short main cutting edge runs ahead of the long main cutting edge in work rotation direction as the next main cutting edge. In this embodiment, it is advantageous that the large bore dust quantity, which the longest main cutting edge or long main cutting edges carves out of the material is shoveled reliably into the bore dust discharge sector, which is located between the longest and the second longest main cutting edge by means of the second longest cutting edge or middle main cutting edge, which is next. Due to the fact that the shortest cutting edge or short main cutting edge runs ahead of the longest cutting edge, the bore dust discharge portion, which runs ahead of the longest cutting edge, is stressed only insignificantly by material, which is removed from the shortest cutting edge.

In a preferred embodiment, the sum of the lengths of all of the main cutting edges in the respective direction of extension is less than about 110 percent, preferably less than about 100 percent, of a nominal drill diameter. Preferably, the sum of the lengths of all of the main cutting edges in the respective direction of extension, including the chisel, is between about 120 percent and about 140 percent of the nominal drill diameter. Due to the low overall length of the main cutting edges, provision can be made for larger portions on the drill head for transporting the cuttings and bore dust discharge grooves can even be formed around the chisel, at which the largest quantity of cuttings accumulates.

Preferably, exactly three main cutting edges are formed. Preferably, a respective main cutting edge is formed as crest between a cutting face, which runs ahead in work rotation direction and an open area, which trails behind in work rotation direction. In particular, a longest of the main cutting edges also comprises a plurality of partial sections, which are located along a continuous crest course, in particular along a straight cutting axis, which intersects the work rotating axis and which are located in the jacket surface of the drilling cone. In particular, the lengths of the partial sections of the main cutting edge add to the length of the main cutting edge.

Preferably, the drill head substantially has a Y-form.

In a preferred embodiment, the length of the second longest of the main cutting edges is between about 60 percent and about 80 percent of the length of the longest of the main cutting edges without chisel. Preferably, the length of the shortest of the main cutting edges is between about 40 percent and about 60 percent of the length of the longest main cutting edge without chisel. Preferably, the length of the shortest of the main cutting edges is between about 55 percent and about 80 percent of the second longest main cutting edge.

In a preferred embodiment, the long main cutting edge with chisel is between 0.5 and 0.8 times, preferably between 0.6 and 0.7 times, as long as the nominal drill head diameter. In particular, the short main cutting edge is between 0.1 and 0.25 times, preferably between 0.15 and 0.2 times, as long as the nominal drill head diameter. In particular, the middle main cutting edge is between 0.15 and 0.35 times, preferably between 0.2 and 0.3 times, as long as the nominal drill head diameter. Preferably, the drill head is embodied in one piece.

According to a third invention aspect, which can also be a further development of the preceding aspects of the invention, a drill head of hard metal for a drill, such as a rock drill, comprising a mounting side to be turned towards a drill shaft of the drill for mounting, preferably welding, the drill head on the drill shaft and a free cutting side with three main cutting edges, which in each case encompass a direction of extension comprising a mainly radial direction component. Intersection points of the directions of extension of the three main cutting edges are in each case located at a radial distance to the work rotation axis of the drill. According to the invention, the radial distances of the intersection points to the work rotation axis have different sizes.

The directions of extension of the main cutting edges are defined by the mainly substantially straight course of the main cutting edges. It is clear that, as specified in the exemplary embodiment below, a main cutting edge can encompass two main directions of extension, which, however, should run parallel to one another. For example, a main cutting edge can encompass a straight cutting edge portion located on this side of the drill tip and a main cutting edge portion, which is located on the other side of the drill tip, wherein the main cutting edge portions are not aligned with one another, but are located parallel to one another. Each direction of extension of the main cutting edges defines a direction of extension or a bundle of parallel directions of extension, which form an intersection point with the directions of extension of the other main cutting edges. The intersection point can thereby actually be an intersection in the room, because the main cutting edges are located on a conical jacket plane, the cone axis of which coincides with the rotation axis of the drill. In the event that the cutting edges are not located in a common conical jacket plane, the intersection points thereof are realized in that only the radial components are considered in the case of a view from the front, so as to determine the intersection points of the directions of extension.

In the event that a main cutting edge defines two or more directions of extension, the main direction of extension, which is defined by the longest straight portion of the main cutting edge, is chosen for determining the three significant intersection points. At least the intersection points with this main direction of extension are located at a radial offset distance to the work rotation axis, which are different. Further directions of extension of the main cutting edge can indeed form intersection points, which encompass a radial offset to the work rotation axis, which is the same as other radial offsets.

All intersection points of the directions of extension are located offset to the work rotation axis. In particular, the intersecting directions of extensions are in each case offset away from the work rotation axis by a direction component, which faces radially away from the work rotation axis and which is located vertically to the respective direction component, which faces radially to the work rotation axis. A larger design scope for a particularly stable, positionally accurate or deeply penetrating chisel tip exists due to the radial offset of the directions of extension of the main cutting edge. The bore dust discharge away from the rotation axis of the drill can furthermore be influenced advantageously according to the characteristic of the radial direction component, which faces away from the work rotation axis.

Due to the different distances of the intersection points to the work rotation axis, it was possible to considerably decrease the chance that an impact recess in the borehole is acted upon once again in response to a rotation as compared to known drills.

Surprisingly, it turned out that a sufficient rotational asymmetry of the drill, which prevents that a main cutting edge, which trails in work rotation direction, falls into the impact recess created by another heading main cutting edge, is already attained with a small distance difference of one of the intersection points of the direction of the extension of the main cutting edges as compared to one of the adjacent intersection points of the direction of extension. All further drill design parameters can initially remain unchanged, so that the largest possible degrees of freedom for the drill designs in view of a maximum drilling efficiency are at hand. The compaction of bore dust in the borehole is reduced due to the reduced chance that a recess, which has already been carved into the drill material, is impacted by a cutting edge again, so that the bore dust discharge is improved and a longer durability of the drill head is attained.

In a preferred embodiment, the in particular only radial distances or radial offsets of the intersection points relative to the work rotation axis are less than 25% of a nominal drill diameter. The nominal drill diameter is the diameter of a circumference, which preferably runs through short sides of drill head legs of the drill head, which face radially outwards, on which the main cutting edges are embodied and has its center point on the work rotation axis of the drill. Preferably, the smallest radial distance of one of the intersection points is less than 10% of the nominal drill diameter, preferably between about 2% and about 5%. In particular, at least one radial distance of one of the intersection points is more than 10% and less than 20%, preferably between about 12% and about 16% of the nominal drill diameter.

In a preferred embodiment, the directions of extension limit two adjacent main bore dust discharge sectors, which are in particular free from any cutting edges. In particular, the main bore dust discharge sectors extend in axial drill extension direction from a jacket surface of a drilling cone, which is spanned by the main cutting edges and the tip of which is located on the work rotation axis, up to helical turns of the drill shaft. In particular, the main bore dust discharge sectors in each case span a main sector angle greater than 120°. By the embodiment of two large main bore dust discharge sectors, the bore dust discharge is increased unexpectedly as compared to the bore dust discharge sectors, which are embodied evenly and symmetrically on the drill head and which have the same bore dust discharge volume, because coarse-grained drill cuttings are discharged more quickly and the bore dust plug formation is thus reduced. A bore dust discharge sector, such as a main bore dust discharge sector as well as an auxiliary bore dust discharge sector are substantially located starting at the main cutting edges through slipping shoulders on the front side, which lead into an axial discharge channel of the drill head, which is formed concavely viewed in radial direction and which extends along the axially running, concavely formed side wall of the drill head up to the helical turn of the drill shaft. An increased bore dust discharge quantity is reached due to the particularly large form of the two main bore dust discharge sectors.

In a further development of the invention, the drill head has a long main cutting edge, which encompasses the longest extension as compared to the other main cutting edges. The drill head furthermore has a short main cutting edge, the longitudinal extension of which is shortest. In addition, the drill head has a middle main cutting edge, which is longer than the short main cutting edge and shorter than the long main cutting edge. Preferably, the shortest radial offset is determined by that intersection point to the work rotation axis, which is defined by the intersection point of the directions of extension of the short main cutting edge and the long main cutting edge. The longest radial offset of an intersection point to the work rotation axis, is defined by the intersection point, which follows when the short main cutting edge intersect the middle main cutting edge. The largest radial offset follows from the point of intersection of the directions of extension of the middle main edge and the long main edge.

In a preferred embodiment, the main cutting edges encompass a different length in direction of extension. In particular, the long main cutting edge forms a crest between the two adjacent main bore dust discharge sectors. In particular, the directions of extension of the middle main cutting edge and the short main cutting edge define an auxiliary bore dust discharge sector. Preferably, the auxiliary bore dust discharge sector spans an auxiliary sector angle of less than or equal to 110°. In particular, the auxiliary bore dust discharge sector extends in axial drill extension direction from the drilling cone up to a helical turn of the drill. Preferably, the auxiliary bore dust discharge sector is occupied by a short portion of the longest of the main cutting edges. The auxiliary bore dust discharge sector discharges bore dust, which is created at the middle main cutting edge and the short main cutting edge, as well as bore dust, which is not transported away completely via the main bore dust discharge sectors and which flows along the longest of the main cutting edges into the auxiliary bore dust discharge channel. The short portion of the long main cutting edge breaks large drill cuttings, so that drill cuttings flow away quickly in spite of the smaller angle of the auxiliary bore dust discharge sector.

In a preferred embodiment, one of the main cutting edges for forming the long main cutting edge comprises a long portion, a short portion and a chisel tip. In particular, the long portion flows uninterruptedly, in particular continuously into the chisel tip, which extends preferably point symmetrically across the work rotation axis. In particular, the chisel tip continues the course of the long main cutting edge, preferably without interruptions in the short portion, which is preferably located diametrically opposite to the long portion and which encompasses a direction of extension with a predominant direction component pointing radially towards a work rotation axis of the drill, which in particular extends parallel offset relative to the direction of extension of the long portion. In particular, the chisel tip is formed in the form of a double curvature having a turning point, which in particular coincides with the work rotation axis, comprising a dome tip for overcoming the offset. The long main cutting edge, which extends in a roof-shaped manner, comprising the chisel as tip, across the drill head, ensures a high feed speed, because it penetrates into the material in a wedge-shaped manner in response to percussion drilling. An even support in the borehole is attained by means of the two further main cutting edges, in accordance with a three-point contact. Due to the three-point contact and the chisel tip, a high positional accuracy and hole quality is reached. The offset of the long portion to the short portion increases the tilting stability of the long main cutting edge in the borehole, which leads to an improved hole quality. The curved double curve shape of the chisel tip is particularly advantageous, because bore dust can flow away, without accumulating on the edges. In the case of a further development of the invention, the chisel tip is located on the work rotation axis of the drill head as drill tip.

In a preferred embodiment, the main cutting edges in each extend from a radially outer end to a radially inner end on the drill head with a constant slope in axial drill feed direction. In particular, the radially inner end of at least one of the main cutting edges runs ahead in work rotation direction relative to the respective direction component, which faces radially to the work rotation axis. Preferably, the radially inner ends of the longest and of the second longest of the main cutting edges run ahead in work rotation direction relative to the respective direction component, which faces radially to the work rotation axis. In particular, the radially inner end of one of the main cutting edges, in particular of the shortest main cutting edge, trails in work rotation direction relative to the corresponding direction component, which faces radially to the work rotation axis, wherein the radially inner and outer ends are in each case determined by a change of the slope. Free bore dust located in the borehole is driven outwardly out of the drill head center into the main bore dust discharge grooves by means of the rotation of the drill head by the radially inner heading main cutting edges.

In a preferred embodiment, the drill head is embodied in one piece. Preferably, exactly three main cutting edges are formed on the drill head. Preferably, all of the main cutting edges are located within the jacket surface of the drilling cone. Preferably, a respective main cutting edge is in each case defined by an uninterrupted, in particular mainly straight crest course between a cutting face and an open area, which is located in the jacket surface or above the jacket surface of the drilling cone. Preferably, the bore dust discharge sectors start at the respective transitions from crest to cutting face and open areas of the main cutting edges, which extend up to the helical turns of the drill shaft (not illustrated) in axial direction of the drill.

In a preferred embodiment, the drill head is connected to the drill tool, so as to be free from a tenon, which is embodied on the drill shaft. Preferably, the mounting side of the drill head is free from offsets, in particular plane. Preferably, the drill head is free from any cutting plates or cutting inserts.

According to a fourth invention aspect, which can also be a further development of the above-described invention aspects, a drill head of hard metal for a drill, such as a rock drill, comprises a mounting side to be turned towards a drill shaft of the drill for mounting the drill head on the drill shaft and a free cutting side with exactly three main cutting edges, the directions of extension of which encompass a radial direction component, which in each case defines a ring-shaped or circular removal area concentrically to the work rotation axis in response to the rotation of the drill head. The removal areas overlap at least partially such that a triple removal area coverage or overlap is provided in an outer ring zone, which extends from a common outer end circumference of in particular exactly three removal areas of the main cutting edges to an intermediate circumference boundary. According to the invention, a double removal area coverage or overlap is provided in an inner ring zone, which extends from the intermediate circumference boundary to the work rotation axis.

The main cutting edge or main cutting edges is preferably defined in that the course thereof is located completely on a conical jacket plane, the rotation axis of which coincides with the work rotation axis of the drill head. The drill head can encompass auxiliary cutting edges or auxiliary cutting edges, which can be located so as to be radially offset to the conical jacket plane. The main cutting edges thereby lead dominantly in response to the drilling process.

The extension expansion of a main cutting edge follows from that portion of the main cutting edge, which is located on the conical jacket plane, wherein a main cutting edge can indeed encompass a central chisel or chisel tip, which protrudes axially beyond the conical jacket surface. A radial component of an extension expansion defines the ring-shaped or circular removal area on the cutting edge in response to the rotation of the drill head. It is clear that, as a general rule, each main cutting edge defines exactly one removal area. One cutting edge might possibly also define two or more removal areas, when the main cutting edge is interrupted in its longitudinal direction, for example. It is also possible that a main cutting edge extends diametrally radially beyond the work rotation axis, so that a first removal area on this side of the drill tip and a further removal area on the other side of the drill tip is defined, but both main cutting edge portions are linked in a continuous run and/or encompass the same direction of extension.

A plurality of zones of different removal area overlap allow to design areas of the drill head to specific functions in response to percussion drilling and to thus improve the overall drilling result. To remove all of the cuttings from the borehole, if possible, in radially outer areas of the drill head and to thus attain lower heat development and a stable and accurate support in the borehole, provision is made for a triple overlap of the removal areas. Only two removal areas overlap so as to attain an improved impact effect into the drill cuttings in response to a low rotational friction in the area close to the drill head tip.

In a preferred embodiment, a double cutting edge ring zone, in which the double removal area overlap is provided by means of two different main cutting edges, is provided in the inner ring zone.

In a preferred embodiment, a single cutting edge ring zone is provided in the inner ring zone, with the double removal area overlap being provided in said single cutting ring zone by means of a main cutting edge, in particular a long portion as well as a short portion of a main cutting edge, which is located diametrally opposite in particular to the long portion relative to the work rotation axis and which in particular connects directly to the long portion on the other side of the work rotation axis.

To realize the double overlap of the removal areas in different zones comprising different cutting edges or comprising only one main cutting edge, respectively, has the advantage that, depending on the radial position on the drill head, different angle distances exist between the main cutting edges. Depending on the radial position, the subsequent removal with the overlapping cutting edge then takes place earlier or later during the course of a rotation, whereby inhomogeneous cuttings are removed more thoroughly at inhomogeneous pouring speed.

The removal area overlap can be varied in that the number of the overlaps changes from one to the next portion of the radius distance, but also in that the main cutting edges, which realize an overlapping, change.

The drill head can encompass a long main cutting edge, which is the longest main cutting edge of the three main cutting edges. The drill head can furthermore encompass a middle main cutting edge and a short main cutting edge, which is the shortest of the main cutting edges. The middle main cutting edge is longer than the short main cutting edge and shorter than the long main cutting edge.

In a preferred embodiment, the double removal area overlap in the double cutting edge ring zone is provided by means of a long main cutting edge and a middle main cutting edge. Preferably, the double removal area overlap in the one cutting edge ring zone is provided by means of a long portion and a short portion of a long main cutting edge. It turns out that the chisel function of the main cutting edges prevails in the vicinity of the rotation axis of the drill due to the lower line speed and that the removal function increases radially outwardly. The chisel effect can be increased and the bore dust discharge can be supported with the advantageous design of providing the overlap by means of only one cutting edge.

In a preferred embodiment, a maximum of three removal areas and at least two removal areas overlap on the drill head. The triple removal area overlap ensures that bore dust, which has already been knocked out after a few rotations, is guided out of the borehole almost completely. The double blade redundancy in the radially outermost radial portion of the main cutting edges turns out to be particularly effective, because the distance across the cutting face, which leads across the main cutting edge, up to the bore dust discharge groove is shortest, so that the bore dust can be shoveled more easily into the discharge groove. At the same time, it was possible to avoid excessive friction resistance in the borehole.

Preferably, the inner ring zone extends across more than 55 percent of a drill head radius. In particular, the circular intermediate circumference boundary runs through a radially inner cutting edge end of the short main cutting edge. It is advantageous thereby that a high hole quality, such as in the case of a drill comprising three main cutting edges, is attained by means of the stabilization of the drill head in the borehole via a three-point contact radially outside of the drill head. Due to the fact that the majority of the drill head, however, encompasses a lower removal area overlap, the total friction is low and the impact energy transfer is high, as in the case of a drill head comprising only one main cutting edge, which extends diametrally cross the rotation axis of the drill.

For the most frequent small drilling granulations, it turns out that a more than triple overlap of a removal area by removal areas of other or of the same main cutting edge does not provide any additional advantage in view of the bore dust discharge effectiveness, but that the rotational friction increases.

In a preferred embodiment, the main cutting edges, in particular the directions of extension thereof, limit two adjacent, in particular cutting edge free main bore dust discharge sectors. In particular, the main bore dust discharge sectors extend in axial direction from a jacket or lateral surface of a drilling cone, which is spanned by the main cutting edges and the cone tip of which is located on the work rotation axis, up to helical turns of the drill. In particular, the main bore dust discharge sectors in each case span a main sector angle, two of which are greater than 120°. Due to the embodiment of two large main bore dust discharge sectors, the bore dust removal is increased unexpectedly as compared to bore dust sectors, which are embodied regularly and symmetrically on the drill head and which comprise the same bore dust discharge volume, because coarse-grained drill cuttings are discharged more quickly and the bore dust plug formation is reduced through this.

In a preferred embodiment, the three main cutting edges along the directions of extension thereof encompass different lengths, so that a long cutting edge, a middle cutting edge and a short cutting edge are formed. In the case of the preferred drill head, the quantity of the generated bore dust is matched accurately to the local bore dust quantity, which can be transported away as a whole, so that less friction-promoting bore dust remains in the borehole, whereby the operating temperature on the drill head and the wear thereof is reduced. With the measure of designing the overall cutting edge length relative to the bore dust quantity, which can be maximally discharged, the drilling capacity is increased relative to the expended mechanical performance, because the friction of the cutting edges is limited to a necessary measure. Surprisingly, this also resulted in an improvement of the feed rate, because impact energy from the hammer drill is now transferred directly to the rock, which is to be drilled, without damping the drill cuttings present in the borehole.

Preferably, the main cutting edges extend from a radially outer end to a radially inner end comprising a constant slope in axial drill feed direction, wherein the radially inner and outer ends are in each case determined by a slope change, wherein a radial distance, in particular a depression in the drill head, which is not occupied by a cutting edge, in particular between the respective radially inner end of the short cutting edge and/or the middle cutting edge and an intersection point of the respective direction of extension with the direction of the extension of the long cutting edge is embodied, for discharging bore dust. In particular, the distance is realized as a valley or groove substantially along the direction of extension of the longest of the main cutting edges. A quantity compensation between the bore dust discharge grooves is made possible by means of the depressions, which run along the long main cutting edge and which connect the main and auxiliary bore dust discharge sectors, so that the overall bore dust discharge capacity is used in a particularly efficient manner.

In a preferred embodiment, the main cutting edges extend in each case on a drill head cutting edge leg of the drill head comprising a constant direction component in axial drill feed direction and span a jacket surface of a drilling cone, the cone tip of which coincides with the work rotation axis of the drill. In particular, the radial width of a respective removal area is determined by the mere radial length, in particular along the radial components of the effective cutting length of the main cutting edges, which is located within or above the jacket surface.

Preferably, a longest of the main cutting edges is defined by an uninterrupted, in particular mainly straight crest course, which is located in the jacket surface or above the jacket surface of the drilling cone and which extends beyond the work rotation axis, if applicable.

In a preferred embodiment, the drill head is embodied in one piece. Preferably, exactly three main cutting edges are embodied on the drill head. All of the main cutting edges are preferably located within the jacket surface of the drilling cone. In a preferred embodiment, the drill head is connected to the drill tool so as to be free from a tenon, which is embodied in particular on the drill shaft. Preferably, the mounting side of the drill head is free from offsets, in particular plane. Preferably, the drill head is free from any cutting plates or cutting inserts.

The invention furthermore relates to a drill, in particular a rock drill, comprising a preferably three-channel bore dust discharge helix, as well as to a drill head according to the invention.

The invention also relates to a drill, in particular a rock drill, comprising a drill shaft, which encompasses an insertion end for insertion into a drill, a bore dust discharge helix, preferably comprising three helical turns, and a drill head according to the invention, which is fastened to a receiving end of the drill shaft, which is located opposite the insertion end.

Further characteristics, advantages and features of the invention follow from the below description of a preferred embodiment by means of the enclosed drawings.

Figure 1:
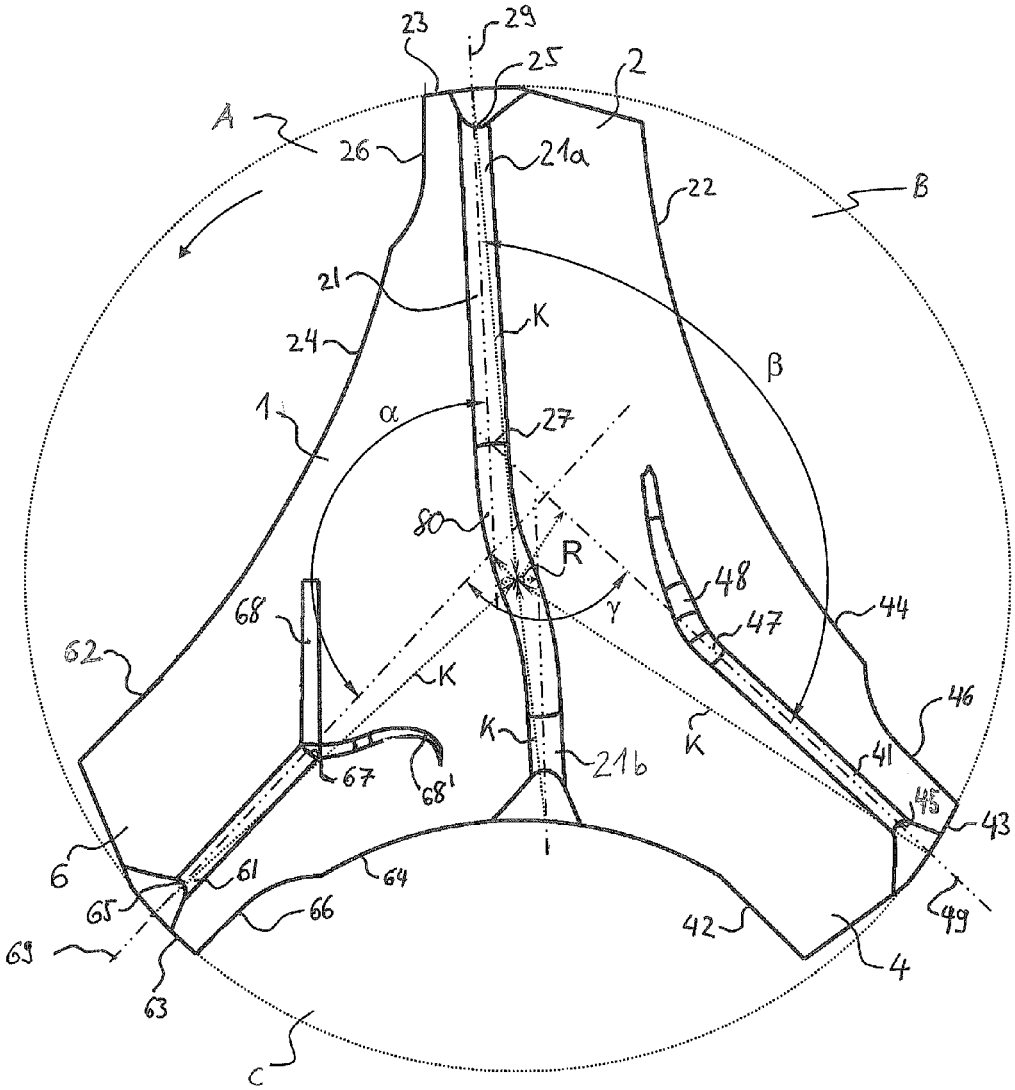
FIG. 1 shows a frontal view from the top of the drill head according to the invention, in particular with regard to the first aspect of the invention.

The drill head 1 according to the invention has substantially a Y shape comprising a base leg 2, from which two side legs 4, 6 extend away substantially symmetrically to the extension of the base leg. The nominal drill diameter is determined by short sides 23, 43, 63, which point radially outwardly, of the Y legs, which, during the course of a work rotation of the drill, move along a cylinder jacket surface, which defines the borehole wall. The work rotation axis R of the drill runs through the center of the drill head and furthermore forms the center of a drill head circumference. The drill head is embodied from a full hard metal body, which extends in downwards direction of the drawing sheet along the rotation axis of the drill. Heading outer long sides 24, 44, 64, which lead into trailing outer long sides 62, 22, 42 of the respective heading Y leg, in each case connect to the short sides 23, 43, 63 of the Y leg, so as to head in drill work rotation direction.

On the respective free cutting edge sides, which face the person looking at the drawing, a main cutting edge 21, 41, 61 is in each case embodied as crest between respective rake and relief faces, which in each case lift away from the drill head in axial feed direction of the drill, as is suggested by contour lines. The cutting edges are of different lengths and extend radially inwardly, straight from a radially outer end 25, 45, 65, which is formed by means of a D-shaped rounding, up to the short sides 23, 43, 63, which face outwardly. The directions of extension 29, 49, 69 of the cutting edges in each case encompass a direction component K, which mainly faces radially towards the work rotation axis R of the drill, as well as a direction component in axial drill feed direction, which is not illustrated in top view.

The main cutting edges comprise portions having a constant slope in axial drill feed direction, which are limited by the roundings at the radially outer ends 25, 45, 65 and by transitions to bore dust guide surfaces, which are suggested by contour lines 48, 68, 68'. The portions having a constant slope define an imaginary lateral or jacket surface of a drilling cone.

The cutting edges divide the drill head into two main bore dust discharge sectors A, B as well as an auxiliary bore dust discharge sector C with the directions of extension thereof 29, 49, 69. The bore dust discharge sectors extend from the jacket surface into helical turns of the drill (not illustrated). The main drill bore dust discharge sectors A, B in each case span a main sector angle $\alpha$, $\beta$ of 135°. The auxiliary bore dust discharge sector C spans an auxiliary sector angle $\gamma$ of 90°.

The long main cutting edge 21, which is located on the Y basis leg, comprises a long portion 21*a*, a short portion 21*b*, which is located opposite the long portion 21*a* relative to the work rotation axis R, and a chisel tip 80, which extends across the rotation axis of the drill and which is located point symmetrically in the form of a double curve, the turning point of which is located on the work rotation axis R of the drill. The long portion 21*a*, the short portion 21*b* and the chisel tip form an uninterrupted cutting edge course, wherein the long and the short portion are located in the drilling cone jacket surface and the chisel tip sticks out of the drilling cone for being centered in axial direction.

The short portion 21*a* divides the side legs 4, 6 substantially centrally and offset parallel to the direction of extension 29 of the long portion 21*b*. The short portion 21*a* extends into the auxiliary bore dust discharge sector C and divides the latter into two partial sectors of approximately the same size.

The middle main cutting edge 41, which directly trails the long main cutting edge 21 in work rotation direction 99, is embodied so as to be shorter than the long main cutting edge 21, but longer than the short main cutting edge 61, which directly heads the long main cutting edge 21 in work direction. On the radially inner ends 47, 67 of the middle main and short main cutting edges, the slope thereof decreases relative to the axial direction, which is suggested in the drawing by means of cross lines to the edges. While the long main cutting edge 21 comprising the chisel section mainly performs the drill feed work, the second longest main cutting edge 41 and the shortest main cutting edge 61 have the additional function of transporting away bore dust and to stabilize the drill head in the borehole in accordance with a three-point support.

A bore dust guide section, which guides released material from the main bore dust discharge sector B into the adjacent auxiliary bore dust discharge sector C and vice versa, if applicable, connects to the middle main cutting edge 41 below the drilling cone, as is suggested by means of the lines 48. A guide surface, which is connected to the short main cutting edge 61 and which is suggested by means of the lines 68, 68', forms a groove channel with the sides of the longest main cutting edge 21, which connects the main bore dust discharge sector A to the auxiliary bore dust discharge sector C for the transverse transport of bore dust.

The main cutting edges run at an angle of less than 30° to the respective radial direction component K, wherein the longest main cutting edge 21 is embodied so as to lead radially inwardly relative to the work rotation direction on the Y basis leg 2 and the medium-long main cutting edge 41 on the Y side leg 4 and the shortest main cutting edge 61 is embodied so as to trail radially inwardly. While the two longer cutting edges 21, 41 effect a major tendency towards the respective directly heading bore dust discharge sector A, B due to the heading orientation in response to the bore dust removal, the trailing orientation of the shortest cutting edge 61 in particular facilitates a bore dust removal from the auxiliary bore dust discharge sector C into the trailing main bore dust discharge sector A.

In a respective heading outer long side 24, 44, 64 of the Y legs, a groove 26, 46, 66 is embodied on the radially outer leg end. In downwards direction of the sheet, the groove runs parallel to the rotation axis of the drill towards the bore dust discharge helix of the drill shaft. Additional bore dust can be discharged by means of the recess on the leg end.

Figure 2:
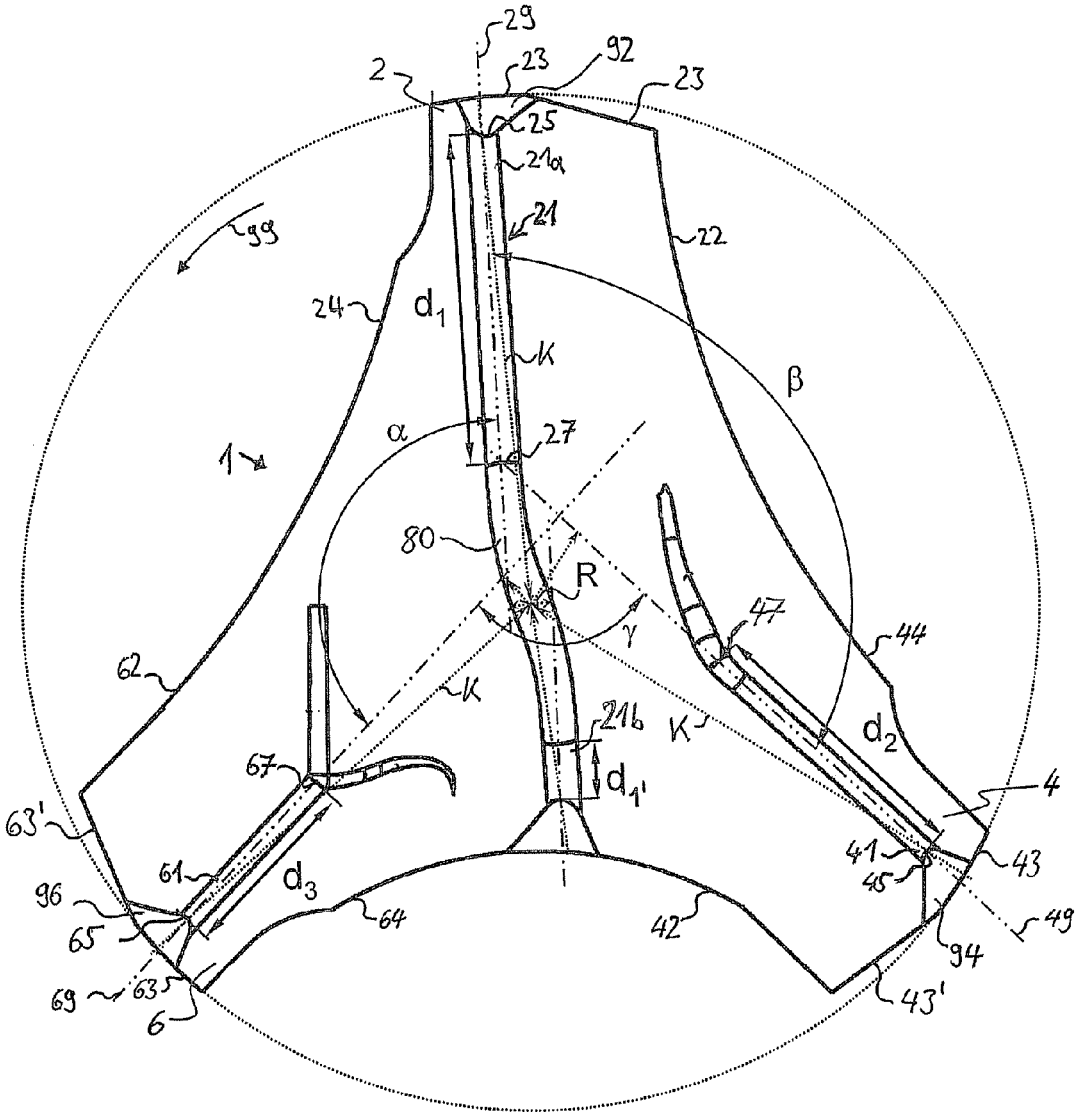
FIG. 2 shows a further frontal view from the top of the drill head according to the invention, in particular with regard to the second aspect of the invention.

As can in particular be seen in FIG. 2, the drill head 1 comprises three drill head cutting edge legs 2, 4, 6, which extend away from a common work rotation axis R, which coincides with the axial rotation axis of that drill, to the drill shaft of which (not illustrated), the drill head is welded with the mounting side (not illustrated).

A respective outer long side 24, 44, 64 of the drill head cutting edge legs 2, 4, 6, which heads in work rotation direction 99 of the drill head, steadily leads into a respective trailing outer long side 62, 22, 42 of a respective drill head cutting edge leg 6, 2, 4, which heads in work rotation direction. The outer long sides 22, 42, 62, 24, 44, 64 are curved towards the drill head rotation axis in a mainly constant manner, so that grooves form, which lead from the free cutting edge sides of the drill head to helical turns of the drill shaft.

Even though it is not illustrated in the top view of the drill head, it should be clear that the drill head extends in downwards direction of the drawing sheet.

The three main cutting edges 21, 41, 61 have different lengths along their respective direction of extension 29, 49, 69 from their radial outer end 25, 45, 65 to the respective radial inner end 27, 47, 67.

The crest of the main cutting edges 21, 41, 61 are located exactly in the jacket surface of the drilling cone, the tip of which is located on the work axis of rotation R. Bore dust discharge sectors, which extend up to the helical turns of the drill shaft (not illustrated) in axial direction of the drill, start at the respective transitions of crest to rake and relief faces of the main cutting edges.

The lengths d1, d2, d3, d1' of the main cutting edges illustrated in the figure are projected into the drawing plane in accordance with the top view and thus do not correspond to the length along the main cutting edges, which can be measured in a three-dimensional space on the drill head and which, however, can be calculated from the axial direction component of the main cutting edges by means of trigonometric formulas. Length specifications, however, refer to the purely radial lengths in drawing plane.

The main cutting edges 21, 41, 61 extend straight, in each case from a radially outer end 25, 45, 65, to a radially inner end 27, 47, 67. The constant slope changes in axial feed direction on the radially outer and inner ends along the main cutting edges, which is suggested in the figure by means of contour lines at right angles to the main cutting edges. A steady transition to substantially Δ-shaped roundings 92, 94, 96, which lead into the outer short sides 23, 43, 63 of the drill head cutting legs 2, 4, 6, is formed on the radially outer ends 25, 45, 65. The susceptibility to breakage of the outer areas of the main cutting edges as well as the rotational friction and tilting chance of the drill head during operation decreases by rounding the transitions from the main cutting edges 21, 41, 61 to the outer short sides of the drill head cutting edge legs 2, 4, 6.

The main cutting edges run straight at an angle of incline of between about 15° and about 40°, based on a plane vertically to the work axis of rotation R, between the respective radially outer end 25, 45, 65 and the radially inner end 27, 47, 67.

Compared to the incline of the straight portions of the main cutting edges 21*a*, 21*b* of the longest main cutting edge and the further main cutting edges 41, 61, the chisel tip 80 has a larger slope based on a vertical plane to the drill rotation axis, so that the chisel protrudes as centering tip in drill feed direction upstream of the cutting edges. The long portion 21*a* and the short portion 21*b* extend parallel offset to one another relative to a common cutting axis (not illustrated), which intersects the work rotation axis of the drill. The long portion 21*a* and the short portion 21*b* are located within the drilling cone and together with the chisel 80 form an uninterrupted cutting edge, which spans the drill head in a roof-shaped manner.

Based on the work rotation direction 99 of the longest main cutting edge 21, the second longest main cutting edge or middle main cutting edge 41 is arranged so as to trail. On the radially inner end 47, the second longest cutting edge levels off in a drill head surface contour, which serves as a bore dust guide aid for the bore dust transport between the bore dust discharge sectors. The shortest cutting edge or short main cutting edge 61 is arranged so as to trail the second longest cutting edge 41 in work rotation direction.

The main bore dust discharge sector defined between the direction of extension 29 of the longest cutting edge 21 and the direction of extension 69 of the shortest cutting edge 61, following the work rotation direction 99, as well as the main bore dust discharge sector, which is defined by the direction of extension 49 of the second longest cutting edge 41 and the direction of extension 29 of the longest cutting edge 21, again following the work rotation direction, in each case span a sector angle α, β of about 135°. An auxiliary bore dust discharge sector is defined between the direction of extension 69 of the shortest cutting edge 61 and the direction of extension 49 of the second longest cutting edge 41 and spans an angle γ of about 90°.

A cutting edge-free area in the form of a groove, which extends in downwards direction of the sheet, along which the bore dust can flow into the main bore dust discharge sectors as well as into the auxiliary bore dust discharge sector, is embodied between the radially inner end 47 of the second longest main cutting edge 41 and the chisel tip. A cutting edge-free distance in the form of a valley, which faces downwards, is likewise embodied between the radially inner end 67 of the shortest cutting edge 61 and the chisel tip, for discharging bore dust.

The entire drill head 1 is made of one piece of carbide and is welded completely to the shaft of the drill, in which a triple helix is embodied, via a mounting side (not illustrated).

A majority (more than 50 percent) of the radially outer short sides 23, 43, 63 of the drill head cutting edge legs 2, 4, 6 is embodied as a respective straight trailing portion 23', 43', 63' so as to be inclined radially inwardly, in order to minimize the hole friction.

Figure 3:
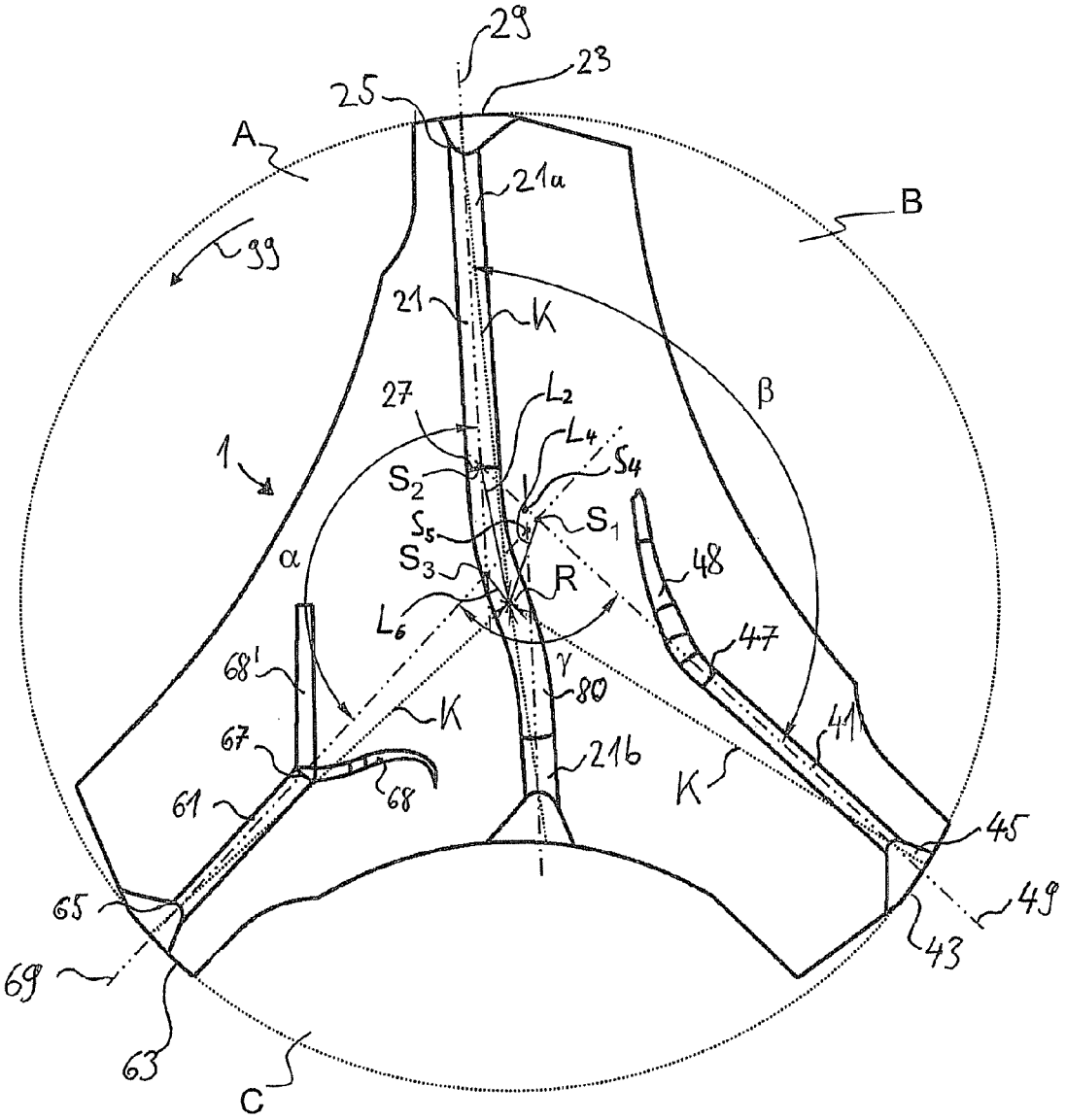
FIG. 3 shows a frontal view from the top of the drill head according to the invention, in particular with regard to the third aspect of the invention.

As can be seen in particular in FIG. 3, bore dust discharge areas, which are curved concavely towards the work rotation axis, extend between the Y legs of the drill head parallel to the work rotation axis in downwards of the sheet direction and lead into helical turns of the drill shaft, which are not illustrated in detail.

The main cutting edges 21, 41, 61 have different lengths and extend from a respective radially outer end 25, 45, 65, which is offset radially inwardly relative to the radially outermost short side 23, 43, 63 of the Y legs in the direction of a work rotation axis R of the drill through a rounding of about 4% of the nominal drill diameter towards radially inner ends 27, 47, 67.

The directions of extension 29, 49, 69 of the main cutting edges 21, 41, 61 intersect one another in intersection points S1, S2, S3, which are not arranged on the work rotation axis R and at different distances L2, L4, L6 thereto. The intersection point S2 between the directions of extension of the long portion 21*a* of the longest main cutting edge or long main cutting edge 21 and the second longest main cutting edge or middle main cutting edge 41 encompasses the largest purely radial distance L6 to the work rotation axis R. The intersection point S1 between the directions of extension of the second longest main cutting edge 41 and the shortest main cutting edge or short main cutting edge 61 encompasses the second largest radial distance L4 from the work rotation axis R. The directions of extension 29, 69 of the long portion 21*a* of the longest main cutting edge 21 and of the shortest main cutting edge 61 meet one another at the intersection point S3, which is closest to the work rotation axis. The short portion 21*b* of the long main cutting edge 21 intersects the direction of extension of the short main cutting edge 61 in the intersection point S5 and intersects the direction of extension of the middle main cutting edge 41 in the intersection point S4.

The main cutting edges 21, 41, 61 in each case run at a different angle to a respective pure radial direction component K. The angles are between about 2° and 20°. Due to the different orientation based on the rotation axis of the drill, none of the main cutting edges fits into an impact recess, which was created in a preceding impact stroke by means of a different one of the main cutting edges.

The short portion 21*b* of the longest cutting edge 21 is embodied in the auxiliary bore dust discharge sector.

The direction of extension of the short portion 21*b* of the longest main cutting edge 21 runs parallel to the direction of extension 21 of the majority of the longest main cutting edge, which is formed by means of the long portion 21*a*, and also intersects the directions of extension 49, 69 of the shortest 61 and second longest 41 main cutting edges outside of the work axis of rotation R.

A distance of cutting edges is in each case left open between the chisel tip 80 and the ends 47, 67 of the second longest 41 and the shortest 61 main cutting edges. In this area of these distances, depressions are included into the drill head 1 along the longest main cutting edge 21 (suggested by means of contours 68, 68', 48), in which bore dust pours away from the main bore dust discharge sectors into the auxiliary bore dust discharge sector and vice versa.

Figure 4:
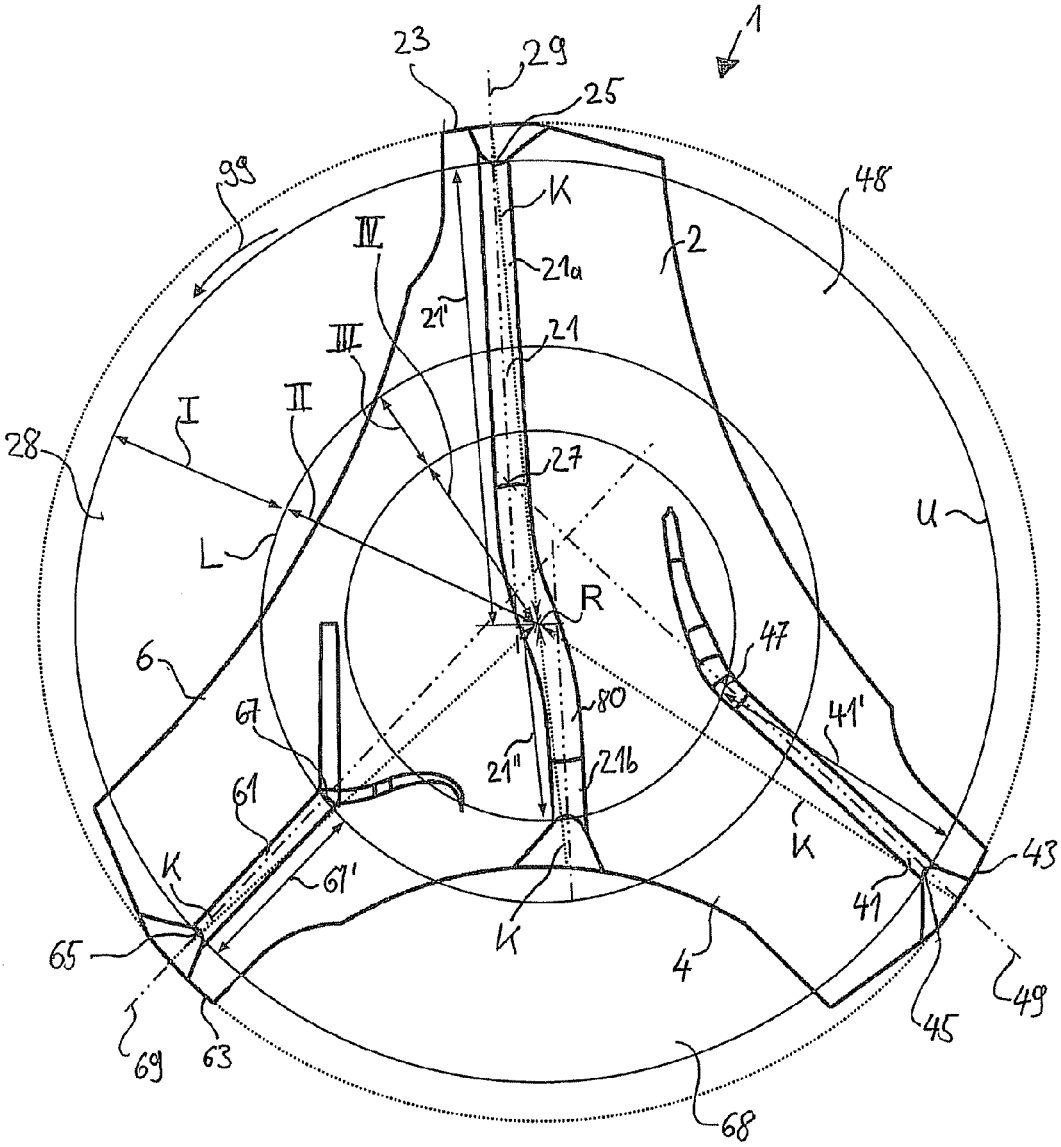
FIG. 4 shows a frontal view from the top of the drill head according to the invention, in particular with regard to the fourth aspect of the invention.

As can be seen in particular in FIG. 4, the extensions of the main cutting edges 21, 41, 61 pass through respective removal areas 21', 21", 41', 61' in the form of a circle or ring within or above the jacket or lateral surface during a 360° rotation of the drill head. The long cutting edge 21, which comprises the chisel tip 80, defines a first removal area with a long portion 21*a* and a second removal area with the short portion 21*b* about the work rotation axis R. The middle cutting edge 41 defines a ring-shaped removal area 41', which extends from a circle about the radially outer end of the short portion 21*b*, which intersects the slope change at the radially inner end 47 of the second longest cutting edge, to the radially outer end 45 of the middle cutting edge 41. The ring-shaped removal area 61' of the short cutting edge 61 extends from the radially inner end 67 thereof to the radial outer end 65.

In a cutting zone IV, in which only the longest main cutting edge 21 operates, the removal area 21' of the long portion 21*a* thereof is covered by the removal area 21" of the short portion 21*b*. Free bore dust is thus either transported away through the long portion 21*a* and the half of the chisel tip 80, which faces the long portion, or after 180° through the short portion 21*b* and the half of the chisel tip 80, which faces the short portion.

A double cutting zone III, in which the removal area of the long portion 21*a* of the long cutting edge and the removal area of the middle cutting edge 41 overlap, connects directly radially outside to the cutting zone IV. The cutting zone IV and double cutting zone III together form an inner ring zone II, in which only a double removal area coverage or overlap exists. Coarse drill cuttings can thus pour away easily and the impact energy is transferred effectively to the drill piece via a slight cutting edge surface.

In the outer ring zone I, the removal areas 21', 41', 61' of the long portion 21*a* of the long cutting edge 21, the middle cutting edge 41 and the short cutting edge 61 overlap one another, so as to transport away as much bore dust as possible, and so as to evenly distribute the tool forces to increase the stability.

The outer ring zone I extends from an outer circumference U, which is defined by the radial outer ends 25, 45, 65 of the main cutting edges 21, 41, 61, up to an intermediate circumference boundary L, which is determined by the radial inner end 67 of the short cutting edge 61.

Due to the different orientation based on the rotation axis of the drill, none of the main cutting edges fits into an impact recess, which was created by another one of the main cutting edges in a preceding impact stroke. The drill cuttings are furthermore guided away from the drill head center to the bore dust discharge grooves.

The features disclosed in the above description, the figure and the claims can be significant for the realization of the invention in the different embodiments, either alone as well as in combination.

REFERENCE SIGNS

1 drill head
2 basis leg
4, 6 side leg
21, 41, 61 main cutting edge
21', 21", 41', 61' removal areas
21*a* long portion
21*b* short portion
22, 42, 62 trailing outer long sides
23, 43, 63 outer short sides
23', 43', 63' straight trailing portion
24, 44, 64 heading outer long sides
25, 45, 65 radially outer ends
27, 47, 67 radially inner ends
29, 49, 69 directions of extension
48 bore dust guiding portion
68, 68' drill head contours
80 chisel tip
92, 94, 96 roundings
99 work rotation direction
$\alpha$, $\beta$ main sector angle
$\gamma$ auxiliary sector angle
A, B main bore dust discharge sector
C auxiliary bore dust discharge sector
$d_1$, $d_1'$, $d_2$, $d_3$ lengths
K direction component
$L_2$, $L_4$, $L_6$ radial distance
R work rotation axis
$S_1$, $S_2$, $S_3$, $S_4$, $S_5$ intersection points
U outer end circumference
L intermediate circumference boundary

The invention claimed is:

1. A drill head for a drill, the drill head comprising:
a mounting side configured for mounting the drill head on a drill shaft of the drill; and
a free cutting side configured for cutting a workpiece, the free cutting side comprising:
a first main cutting edge having a straight first direction of extension with a first predominant radial direction component pointing towards an axial work rotation axis of the drill head;
a second main cutting edge having a straight second direction of extension with a second predominant radial direction component pointing towards the axial work rotation axis; and
a third main cutting edge having a straight third direction of extension with a third predominant radial direction component pointing towards the axial work rotation axis;
wherein the first direction of extension and the third direction of extension define a first main bore dust discharge sector spanning a first main sector angle;
wherein the first direction of extension and the second direction of extension define a second main bore dust discharge sector spanning a second main sector angle;
wherein each of the first main sector angle and the second main sector angle is greater than 120°; and
wherein the first direction of extension and the second direction of extension intersect at an intersection point that is radially offset from the axial work rotation axis.

2. The drill head according to claim 1, wherein the first main sector angle is equal to the second main sector angle.

3. The drill head according to claim 1, wherein the second direction of extension and the third direction of extension define an auxiliary bore dust discharge sector spanning an auxiliary sector angle, and wherein the auxiliary sector angle is less than or equal to 110° and greater than 20°.

4. The drill head according to claim 3, wherein the first main cutting edge comprises a chisel tip and a short portion connected to the chisel tip, wherein the short portion and at least a portion of the chisel tip are positioned within the auxiliary bore dust discharge sector, and wherein a direction of extension of the short portion divides the auxiliary bore dust discharge sector into two auxiliary bore dust discharge sub-sectors having equal auxiliary sub-sector angles.

5. The drill head according to claim 3, wherein the auxiliary sector angle is less than or equal to 110° and greater than 50°.

6. The drill head according to claim 3, wherein the auxiliary sector angle is between 100° and 90°.

7. The drill head according to claim 1, wherein the first main cutting edge has a first length, wherein the second main cutting edge has a second length that is less than the first length, wherein the third main cutting edge has a third length that is less than the second length, wherein the first main cutting edge comprises a chisel tip positioned symmetrically relative to the axial work rotation axis, and a long portion and a short portion positioned diametrically opposite to each other relative to the axial work rotation axis and each flowing uninterruptedly into the chisel tip.

8. The drill head according to claim 1, wherein the first main cutting edge, the second main cutting edge, and the third main cutting edge do not intersect one another, wherein the first main cutting edge and the second main cutting edge each extend from a radially outer end to a radially inner end with a constant slope relative to an axial direction of the drill head, and wherein the radially inner ends and the radially outer ends are defined by a change of the slope.

9. The drill head according to claim 1, wherein the drill head is not rotationally symmetric about the axial work rotation axis.

10. The drill head according to claim 1, wherein the drill head comprises a Y-shaped body comprising a base leg, a first side leg, and a second side leg, and wherein wall surfaces of the base leg, the first side leg, and the second side leg have a concave shape in a radial direction of the drill head and limit corresponding bore dust discharge sectors that extend parallel to the axial work rotation axis and fade into a corresponding helical turning of the drill shaft.

11. The drill head according to claim 1, wherein the first main bore dust discharge sector and the second main bore dust discharge sector are free of further cutting edges.

12. The drill head according to claim 1, wherein the first main bore dust discharge sector extends in an axial direction of the drill head from a lateral surface of a drilling cone spanned by the first main cutting edge, the second main cutting edge, and the third main cutting edge, wherein the second main bore dust discharge sector extends in the axial direction of the drill head from the lateral surface of the drilling cone, and wherein a tip of the drilling cone is located on the axial work rotation axis.

13. The drill head according to claim 1, wherein each of the first main sector angle and the second main sector angle is between 125° and 150°.

14. The drill head according to claim 13, wherein each of the first main sector angle and the second main sector angle is between 130° and 135°.

15. The drill head according to claim 1, wherein the first main cutting edge has a first length, wherein the second main cutting edge has a second length that is less than the first length, wherein the third main cutting edge has a third length that is less than the second length.

16. The drill head according to claim 1, wherein the first main cutting edge, the second main cutting edge, and the third main cutting edge are formed in one piece with the drill head.

17. A drill comprising:

a drill shaft comprising a plug-in end for inserting the drill shaft into a drilling apparatus;

a triple channelled bore dust discharge helix defined in the drill shaft; and a drill head installed at a receiving end of the drill shaft positioned opposite the plug-in end, the drill head comprising:

a mounting side mounted on the drill shaft; and a free cutting side configured for cutting a workpiece, the free cutting side comprising:

a first main cutting edge having a straight first direction of extension with a first predominant radial direction component pointing towards an axial work rotation axis of the drill;

a second main cutting edge having a straight second direction of extension with a second predominant radial direction component pointing towards the axial work rotation axis; and a third main cutting edge having a straight third direction of extension with a third predominant radial direction component pointing towards the axial work rotation axis;

wherein the first direction of extension and the third direction of extension define a first main bore dust discharge sector spanning a first main sector angle;

wherein the first direction of extension and the second direction of extension define a second main bore dust discharge sector spanning a second main sector angle;

wherein each of the first main sector angle and the second main sector angle is greater than 120°; and wherein the first direction of extension and the second direction of extension intersect at an intersection point that is radially offset from the axial work rotation axis.

18. A drill head for a drill, the drill head comprising:

a mounting side configured for mounting the drill head on a drill shaft of the drill; and a free cutting side configured for cutting a workpiece, the free cutting side comprising:

a first main cutting edge having a straight first direction of extension with a first predominant radial direction component pointing towards an axial work rotation axis of the drill head and having a first length along the first direction of extension;

a second main cutting edge having a straight second direction of extension with a second predominant radial direction component pointing towards the axial work rotation axis and having a second length along the second direction of extension; and a third main cutting edge having a straight third direction of extension with a third predominant radial direction component pointing towards the axial work rotation axis and having a third length along the third direction of extension;

wherein the first length, the second length, and the third length are different from one another; and wherein the first main cutting edge, the second main cutting edge, and the third main cutting edge each extend with a constant slope relative to an axial direction of the drill head from a radial outer end to a radially inner end, wherein the radially inner ends and the radially outer ends are defined by a change of the slope.

19. The drill head according to claim 18, wherein each of the first main cutting edge, the second main cutting edge, and the third main cutting edge extends in the axial direction of the drill head and spans a lateral surface of a drilling cone, wherein a tip of the drilling cone is located on the axial work rotation axis, and wherein the first length, the second length, and the third length are defined by respective portions of the first main cutting edge, the second main cutting edge, and the third main cutting edge that lie within the lateral surface.

20. The drill head according to claim 18, wherein the first direction of extension and the third direction of extension define a first main bore dust discharge sector, wherein the first direction of extension and the second direction of extension define a second main bore dust discharge sector, wherein the first main bore dust discharge sector and the second main bore dust discharge sector each extend in the axial direction of the drill head from a lateral surface of a drilling cone spanned by the first main cutting edge, the second main cutting edge, and the third main cutting edge, wherein a tip of the drilling cone is located on the axial work rotation axis, and wherein the first main cutting edge forms a crest between the first main bore dust discharge sector and the second main bore dust discharge sector.

21. The drill head according to claim 20, wherein the first main bore dust discharge sector spans a first main sector angle, wherein the second main bore dust discharge sector spans a second main sector angle, and wherein each of the first main sector angle and the second main sector angle is greater than 120°.

22. The drill head according to claim 18, wherein the second direction of extension and the third direction of extension define an auxiliary bore dust discharge sector spanning an auxiliary sector angle, and wherein the auxiliary sector angle is equal to or less than 110°.

23. The drill head according to claim 18, wherein the first main cutting edge comprises a chisel tip, and a long portion and a short portion formed diametrically opposite one another relative to the axial work rotation axis, and wherein the chisel tip is located on the axial work rotation axis.

24. The drill head according to claim 18, wherein the first main cutting edge runs ahead of the second main cutting edge relative to a work rotation direction of the drill head, wherein the second main cutting edge runs ahead of the third main cutting edge relative to the work rotation direction, and wherein the third main cutting edge runs ahead of the first main cutting edge in work rotation direction.

25. The drill head according to claim 18, wherein a sum of the first length, the second length, and the third length is less than 110% of a nominal diameter of the drill bit, and wherein a sum of the first length, the second length, the third length, and a length of a chisel of the drill head is between 120% and 140% of the nominal diameter of the drill bit.

26. The drill head according to claim 18, wherein the second length is between 60% and 80% of the first length.

27. The drill head according to claim 18, wherein the third length is between 40% and 60% of the first length.

28. The drill head according to claim 27, wherein the third length is between 55% and 80% of the second length.

29. The drill head according to claim 18, wherein a sum of the first length and a length of a chisel of the drill head is between 0.5 and 0.8 times as long as a nominal diameter of the drill head, wherein the third length is between 0.1 and 0.25 times as long as the nominal diameter of the drill head, and wherein the second length is between 0.15 and 0.35 times as long as the nominal diameter of the drill head.

30. A drill comprising:

a drill shaft comprising a plug-in end for inserting the drill shaft into a drilling apparatus;

a triple channelled bore dust discharge helix defined in the drill shaft; and a drill head installed at a receiving end of the drill shaft positioned opposite the plug-in end, the drill head comprising:

a mounting side mounted on the drill shaft; and a free cutting side configured for cutting a workpiece, the free cutting side comprising:

a first main cutting edge having a straight first direction of extension with a first predominant radial direction component pointing towards an axial work rotation axis of the drill and having a first length along the first direction of extension;

a second main cutting edge having a straight second direction of extension with a second predominant radial direction component pointing towards the axial work rotation axis and having a second length along the second direction of extension; and a third main cutting edge having a straight third direction of extension with a third predominant radial direction component pointing towards the axial work rotation axis and having a third length along the third direction of extension;

wherein the first length, the second length, and the third length are different from one another; and wherein the first main cutting edge, the second main cutting edge, and the third main cutting edge each extend with a constant slope relative to an axial direction of the drill head from a radial outer end to a radially inner end, wherein the radially inner ends and the radially outer ends are defined by a change of the slope.

31. A drill head for a drill, the drill head comprising:

a mounting side configured for mounting the drill head on a drill shaft of the drill; and a free cutting side configured for cutting a workpiece, the free cutting side comprising:

a first main cutting edge having a straight first direction of extension with a first predominant radial direction component pointing towards an axial work rotation axis of the drill head and defining a first removal area positioned concentrically relative to the axial work rotation axis;

a second main cutting edge having a straight second direction of extension with a second predominant radial direction component pointing towards the axial work rotation axis and defining a second removal area positioned concentrically relative to the axial work rotation axis; and a third main cutting edge having a straight third direction of extension with a third predominant radial direction component pointing towards the axial work rotation axis and defining a third removal area positioned concentrically relative to the axial work rotation axis;

wherein the first removal area, the second removal area, and the third removal area overlap one another along an outer ring zone extending from a common outer end circumference of the first removal area, the second removal area, and the third removal area to an intermediate circumference boundary, such that the first main cutting edge, the second main cutting edge, and the third main cutting edge provide triple removal within the outer ring zone;

wherein the first removal area and the second removal area overlap one another along an inner ring zone extending from the intermediate circumference boundary toward the axial work rotation axis, such that the first main cutting edge and the second main cutting edge provide double removal within the inner ring zone; and wherein the first main cutting edge, the second main cutting edge, and the third main cutting edge each extend from a radially outer end, located on the common outer end circumference, to a radially inner end with a constant slope in an axial direction of the drill head.

32. The drill head according to claim 31, wherein the first removal area does not overlap the second removal area or the third removal area along an inner circular zone extending from the inner ring zone to the axial work rotation axis.

33. The drill head according to claim 32, wherein the first main cutting edge comprises a long portion and a short portion positioned diametrically opposite one another relative to the axial work direction axis.

34. The drill head according to claim 33, wherein the long portion and the short portion of the first main cutting edge provide double removal within the inner circular zone.

35. The drill head according to claim 31, wherein an inner portion of the second removal area overlaps a portion of the first removal area along the inner ring zone.

36. The drill head according to claim 31, wherein the inner ring zone extends over at least 45% of a radius of the drill head, and wherein the intermediate circumference boundary extends through a radially inner end of the third main cutting edge.

37. The drill head according to claim 31, wherein the first direction of extension and the third direction of extension define a first main bore dust discharge sector spanning a first main sector angle, wherein the first direction of extension and the second direction of extension define a second main bore dust discharge sector spanning a second main sector angle, wherein the first main bore dust discharge sector and the second main bore dust discharge sector each extend in an axial direction of the drill head from a lateral surface of a drilling cone spanned by the first main cutting edge, the second main cutting edge, and the third main cutting edge, wherein a tip of the drilling cone is located on the axial work rotation axis, wherein the first main cutting edge forms a crest between the first main bore dust discharge sector and the second main bore dust discharge sector, and wherein each of the first main sector angle and the second main sector angle is greater than 120°.

38. The drill head according to claim 31, wherein the first main cutting edge has a first length, wherein the second main cutting edge has a second length, wherein the third main cutting edge has a third length, wherein the first length, the second length, and the third length are different from one another, and wherein each of the radially inner end and the radially outer end is defined by a change in the slope.

39. The drill head according to claim 31, wherein each of the first main cutting edge, the second main cutting edge, and the third main cutting edge extends on a corresponding cutting leg of the drill head with a constant direction component in an axial direction of the drill head and spans a lateral surface of a drilling cone, and wherein a tip of the drilling cone is located on the axial work rotation axis.

40. The drill head according to claim 31, wherein the first direction of extension and the second direction of extension intersect one another at a first intersection point that is radially offset from the axial work rotation axis by a first radial distance, wherein the second direction of extension and the third direction of extension intersect one another at a second intersection point that is radially offset from the axial work rotation axis by a second radial distance, wherein the first direction of extension and the third direction of extension intersect one another at a third intersection point that is radially offset from the axial work rotation axis by a third radial distance, and wherein the first radial distance, the second radial distance, and the third radial distance are different from one another.

41. A drill comprising:

a drill shaft comprising a plug-in end for inserting the drill shaft into a drilling apparatus;

a triple channelled bore dust discharge helix defined in the drill shaft; and a drill head installed at a receiving end of the drill shaft positioned opposite the plug-in end, the drill head comprising:

a mounting side mounted on the drill shaft; and a free cutting side configured for cutting a workpiece, the free cutting side comprising:

a first main cutting edge having a straight first direction of extension with a first predominant radial direction component pointing towards an axial work rotation axis of the drill and defining a first removal area positioned concentrically relative to the axial work rotation axis;

a second main cutting edge having a straight second direction of extension with a second predominant radial direction component pointing towards the axial work rotation axis and defining a second removal area positioned concentrically relative to the axial work rotation axis; and a third main cutting edge having a straight third direction of extension with a third predominant radial direction component pointing towards the axial work rotation axis and defining a third removal area positioned concentrically relative to the axial work rotation axis;

wherein the first removal area, the second removal area, and the third removal area overlap one another along an outer ring zone extending from a common outer end circumference of the first removal area, the second removal area, and the third removal area to an intermediate circumference boundary, such that the first main cutting edge, the second main cutting edge, and the third main cutting edge provide triple removal within the outer ring zone;

wherein the first removal area and the second removal area overlap one another along an inner ring zone extending from the intermediate circumference boundary toward the axial work rotation axis, such that the first main cutting edge and the second main cutting edge provide double removal within the inner ring zone; and wherein the first main cutting edge, the second main cutting edge, and the third main cutting edge each extend from a radially outer end, located on the common outer end circumference, to a radially inner end with a constant slope in an axial direction of the drill head.

42. A drill head for a drill, the drill head comprising:

a mounting side configured for mounting the drill head on a drill shaft of the drill; and a free cutting side configured for cutting a workpiece, the free cutting side comprising:

a first main cutting edge having a straight first direction of extension with a first predominant radial direction component pointing towards an axial work rotation axis of the drill head;

a second main cutting edge having a straight second direction of extension with a second predominant radial direction component pointing towards the axial work rotation axis; and a third main cutting edge having a straight third direction of extension with a third predominant radial direction component pointing towards the axial work rotation axis;

wherein the first direction of extension and the second direction of extension intersect one another at a first intersection point that is radially offset from the axial work rotation axis by a first radial distance;

wherein the second direction of extension and the third direction of extension intersect one another at a second intersection point that is radially offset from the axial work rotation axis by a second radial distance;

wherein the first direction of extension and the third direction of extension intersect one another at a third intersection point that is radially offset from the axial work rotation axis by a third radial distance; and wherein the first radial distance, the second radial distance, and the third radial distance are different from one another.

43. The drill head according to claim 42, wherein each of the first radial distance, the second radial distance, and the third radial distance is less than 25% of a nominal diameter of the drill head, wherein the shortest of the first radial distance, the second radial distance, and the third radial distance is less than 10% of the nominal diameter of the drill head, and wherein at least one of the first radial distance, the second radial distance, and the third radial distance is greater than 10% and less than 20% of the nominal diameter of the drill head.

44. The drill head according to claim 42, wherein the first main cutting edge, the second main cutting edge, and the third main cutting edge each extend from a radially outer end to a radially inner end with a constant slope in an axial direction of the drill head, wherein each of the radially inner end and the radially outer end is defined by a change in the slope, wherein the radially inner end of at least one of the first main cutting edge, the second main cutting edge, and the third main cutting edge runs ahead of the corresponding radial direction component, and wherein the radially inner end of at least one of the first main cutting edge, the second main cutting edge, and the third main cutting edge lags behind the corresponding radial direction component.

45. The drill head according to claim 42, wherein the first main cutting edge, the second main cutting edge, and the third main cutting edge are formed in one piece with the drill head.

46. A drill comprising:

a drill shaft comprising a plug-in end for inserting the drill shaft into a drilling apparatus;

a triple channelled bore dust discharge helix defined in the drill shaft; and a drill head installed at a receiving end of the drill shaft positioned opposite the plug-in end, the drill head comprising:

a mounting side mounted on the drill shaft; and a free cutting side configured for cutting a workpiece, the free cutting side comprising:

a first main cutting edge having a straight first direction of extension with a first predominant radial direction component pointing towards an axial work rotation axis of the drill head;

a second main cutting edge having a straight second direction of extension with a second predominant radial direction component pointing towards the axial work rotation axis; and a third main cutting edge having a straight third direction of extension with a third predominant radial direction component pointing towards the axial work rotation axis;

wherein the first direction of extension and the second direction of extension intersect one another at a first intersection point that is radially offset from the axial work rotation axis by a first radial distance;

wherein the second direction of extension and the third direction of extension intersect one another at a second intersection point that is radially offset from the axial work rotation axis by a second radial distance;

wherein the first direction of extension and the third direction of extension intersect one another at a third intersection point that is radially offset from the axial work rotation axis by a third radial distance; and wherein the first radial distance, the second radial distance, and the third radial distance are different from one another.

* * * * *